US007225765B2

(12) United States Patent
Leech et al.

(10) Patent No.: US 7,225,765 B2
(45) Date of Patent: Jun. 5, 2007

(54) ENGINE ASSEMBLY

(75) Inventors: Paul A. Leech, Fox Point, WI (US); Brian P. Saiia, Milwaukee, WI (US); Christina E. Wisler, Waukesha, WI (US)

(73) Assignee: Briggs and Stratton Corporation, Wauwatosa, WI (US)

( * ) Notice: Subject to any disclaimer, the term of this patent is extended or adjusted under 35 U.S.C. 154(b) by 0 days.

(21) Appl. No.: 11/417,798

(22) Filed: May 4, 2006

(65) Prior Publication Data

US 2006/0266308 A1 Nov. 30, 2006

Related U.S. Application Data

(60) Provisional application No. 60/689,962, filed on Jun. 13, 2005, provisional application No. 60/684,689, filed on May 26, 2005.

(51) Int. Cl.
*F01P 1/02* (2006.01)
*F01P 7/04* (2006.01)
*F02B 77/00* (2006.01)

(52) U.S. Cl. ..... 123/41.7; 123/41.65; 123/198 E

(58) Field of Classification Search ..... 123/41.7, 123/41.63, 41.56, 198 E, 41.65
See application file for complete search history.

(56) References Cited

U.S. PATENT DOCUMENTS

| | | | | |
|---|---|---|---|---|
| 2,601,907 | A | | 7/1952 | Burrows et al. |
| 3,183,899 | A | | 5/1965 | Tuggle |
| 3,252,449 | A | | 5/1966 | Couchman, Jr. et al. |
| 3,586,238 | A | | 6/1971 | Schmierer et al. |
| D229,612 | S | | 12/1973 | German |
| 3,952,712 | A | | 4/1976 | Hermanson |
| 4,071,206 | A | | 1/1978 | Magill |
| 4,098,218 | A | | 7/1978 | Pichl |
| 4,175,630 | A | | 11/1979 | Fleisher et al. |
| 4,234,050 | A | | 11/1980 | Condon |
| 4,286,682 | A | | 9/1981 | Stewart et al. |
| 4,358,303 | A | | 11/1982 | Rakow |
| 4,514,983 | A | * | 5/1985 | Gaiser ..... 220/501 |
| 4,698,975 | A | | 10/1987 | Tsukamoto et al. |
| 4,805,716 | A | | 2/1989 | Tsunoda et al. |
| 4,838,908 | A | | 6/1989 | Bader et al. |
| 4,841,929 | A | | 6/1989 | Tuggle et al. |
| 5,046,458 | A | | 9/1991 | Kronich |
| 5,285,751 | A | | 2/1994 | Liegeois et al. |
| 5,494,006 | A | | 2/1996 | Davis, Jr. |
| 6,145,479 | A | | 11/2000 | Rotter |
| 6,612,458 | B2 | | 9/2003 | Balzer et al. |
| 6,715,626 | B2 | | 4/2004 | Balzer et al. |
| 6,750,556 | B2 | | 6/2004 | Sodemann et al. |
| 6,896,293 | B2 | | 5/2005 | Philipps et al. |
| 6,904,883 | B2 | | 6/2005 | Snyder et al. |
| 6,905,042 | B2 | | 6/2005 | Eberhardt et al. |
| 2004/0144584 | A1 | | 7/2004 | Phillips, III et al. |

* cited by examiner

*Primary Examiner*—Noah P. Kamen
(74) *Attorney, Agent, or Firm*—Michael Best & Friedrich LLP

(57) ABSTRACT

The present invention provides an engine assembly including an engine housing, a fan that generates an airflow, a fan housing at least partially covering the engine housing and the fan to direct the airflow over the engine housing, and a fuel tank including a plurality of integrally-formed projections engaging the fan housing to couple the fuel tank to the fan housing.

10 Claims, 7 Drawing Sheets

ENGINE ASSEMBLY

RELATED APPLICATIONS

This application claims priority to co-pending U.S. Provisional Patent Application Ser. No. 60/689,962 filed on Jun. 13, 2005 and co-pending U.S. Provisional Patent Application Ser. No. 60/684,689 filed on May 26, 2005, all of which are incorporated herein by reference.

FIELD OF THE INVENTION

The present invention relates to engines, and more particularly to engines having a fuel tank mounted thereon.

BACKGROUND OF THE INVENTION

When used in applications such as walk-behind lawn mowers and snow throwers, small, one or two-cylinder engines often have a fuel tank mounted thereon. Such a fuel tank is often connected to the engine by several fasteners. However, to use the same engine in a riding application, such as a riding lawn mower, it is often desirable to position the fuel tank remote from the engine. As a result, several components of the engine often need to be substantially re-configured to provide for the remote positioning of the fuel tank, which can yield increased costs to the engine manufacturer.

SUMMARY OF THE INVENTION

The fuel tank of the present invention allows the same engine to be used in both walk-behind applications requiring an attached fuel tank and riding lawn mower or other applications requiring a remotely-positioned fuel tank. When the engine is to be used with a walk-behind mower, the engine manufacturer may provide an engine assembly including an engine housing, a fan that generates an airflow, a fan housing at least partially covering the engine housing and the fan to direct the airflow over the engine housing, and a fuel tank including a plurality of integrally-formed projections engaging the fan housing to couple the fuel tank to the fan housing.

When the engine is to be used with a riding mower or other application having a detached or remote fuel tank, in which a remote fuel tank is often provided by the original equipment manufacturer, the engine manufacturer may interchange the fan housing configured to receive the integrally-formed projections on the fuel tank to a fan housing that is not configured to receive the projections. Such interchangeability allows the engine manufacturer to use the same tooling to create both fan housings. Only an extra manufacturing step is required to configure the fan housing to receive the projections, and a longer fuel line may be needed for the remote fuel tank.

The present invention provides, in another aspect, a fuel tank adapted to be coupled to an engine. The fuel tank includes a hollow body defining a fuel chamber therein and a plurality of locking members integrally formed with the body. The locking members are adapted to engage the engine to couple the body to the engine.

The present invention provides, in yet another aspect, an engine assembly including an engine housing, a crankshaft rotatably supported in the engine housing, one end of the crankshaft including a threaded bore defining a central axis, a flywheel positioned adjacent the engine housing and coupled for rotation with the crankshaft about the central axis, a fan separate from the flywheel and rotatable with the flywheel about the central axis, and a screen rotatable with the fan about the central axis. The engine assembly also includes a retainer cup rotatable with the screen about the central axis. The retainer cup includes a flange extending radially outwardly from the central axis and engaging the screen. The engine assembly further includes a single fastener passing through the retainer cup, the screen, and the fan to threadably engage the threaded bore in the crankshaft and axially retain the flywheel, the fan, the screen, and the retainer cup to the crankshaft. The screen and the fan are sandwiched between the flywheel and the flange of the retainer cup. The fan is axially restrained in a first direction along the central axis by the flywheel. The fan is axially restrained in a second direction along the central axis only by the screen and the flange of the retainer cup.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
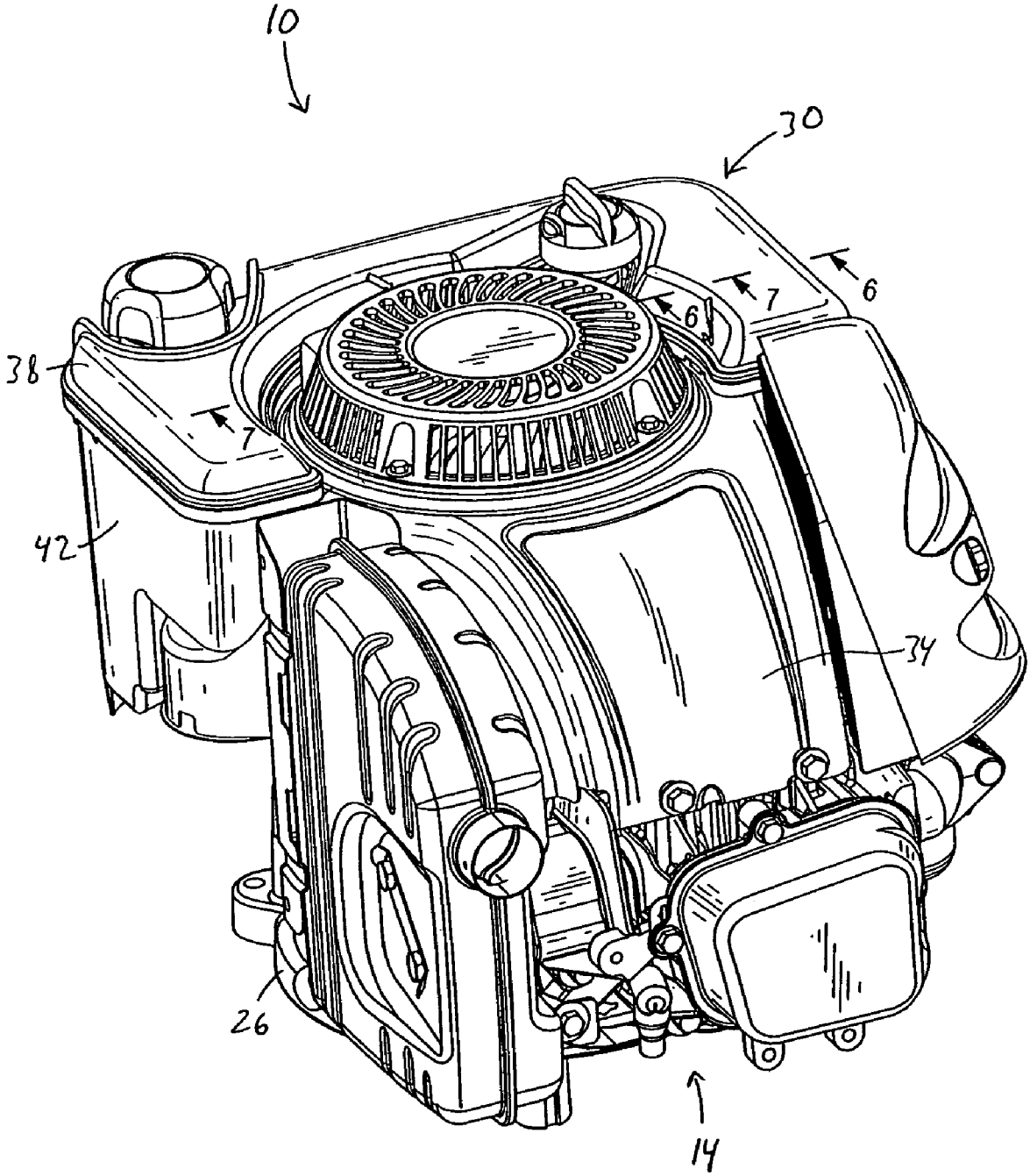
FIG. 1 is a front perspective view of the engine assembly of the present invention.

FIG. 1 illustrates an engine assembly 10 including a four-cycle, air-cooled single cylinder engine 14. Such a "small" engine 14 may be configured with a power output as low as about 1 Hp and as high as about 35 Hp to operate engine-driven outdoor power equipment (e.g., lawn mowers, lawn tractors, snow throwers, etc.). The illustrated engine 14 is also configured as a vertical shaft engine 14.

Figure 2:
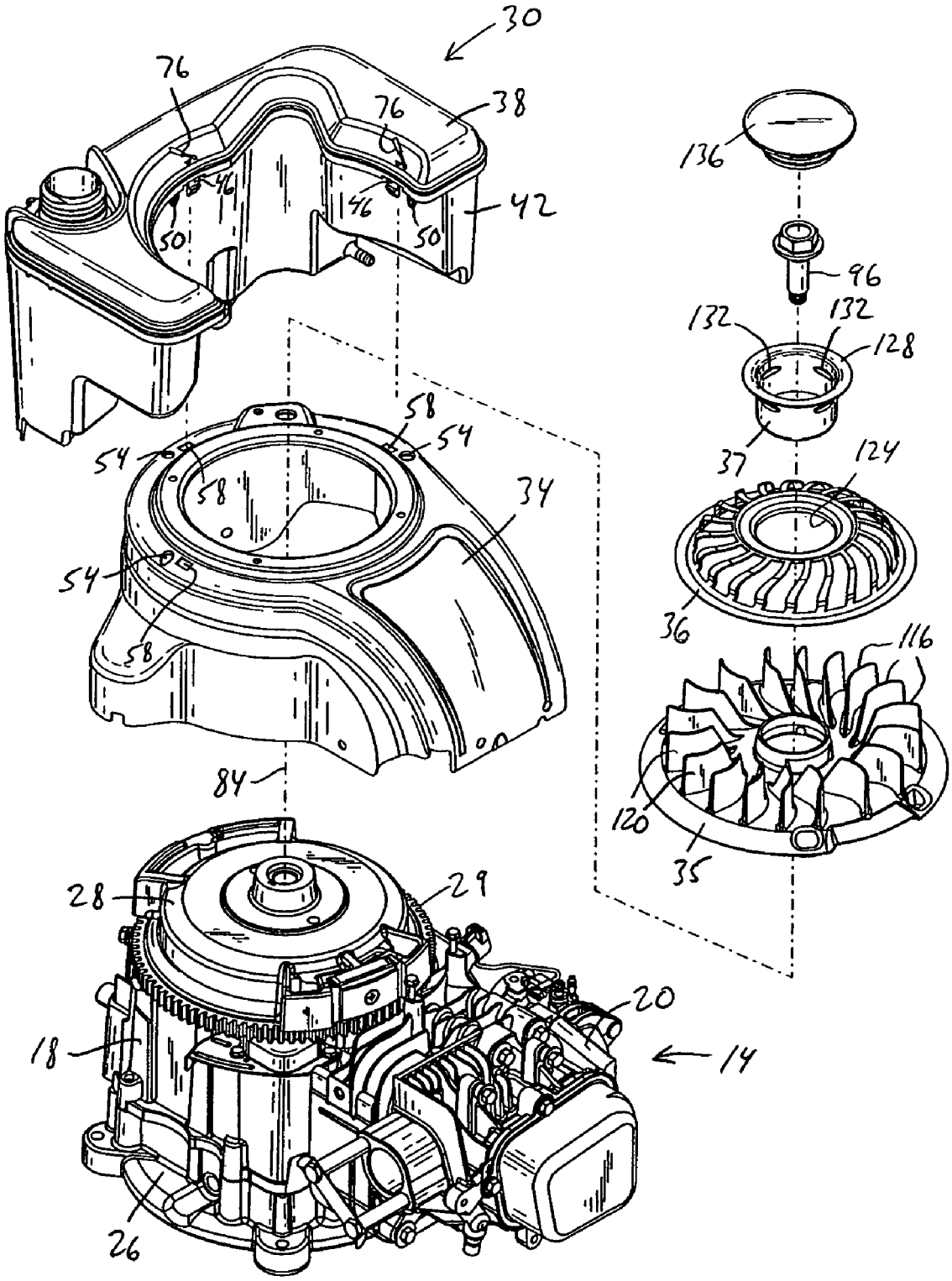
FIG. 2 is an exploded, front perspective view of the engine assembly of FIG. 1.
Figure 5:
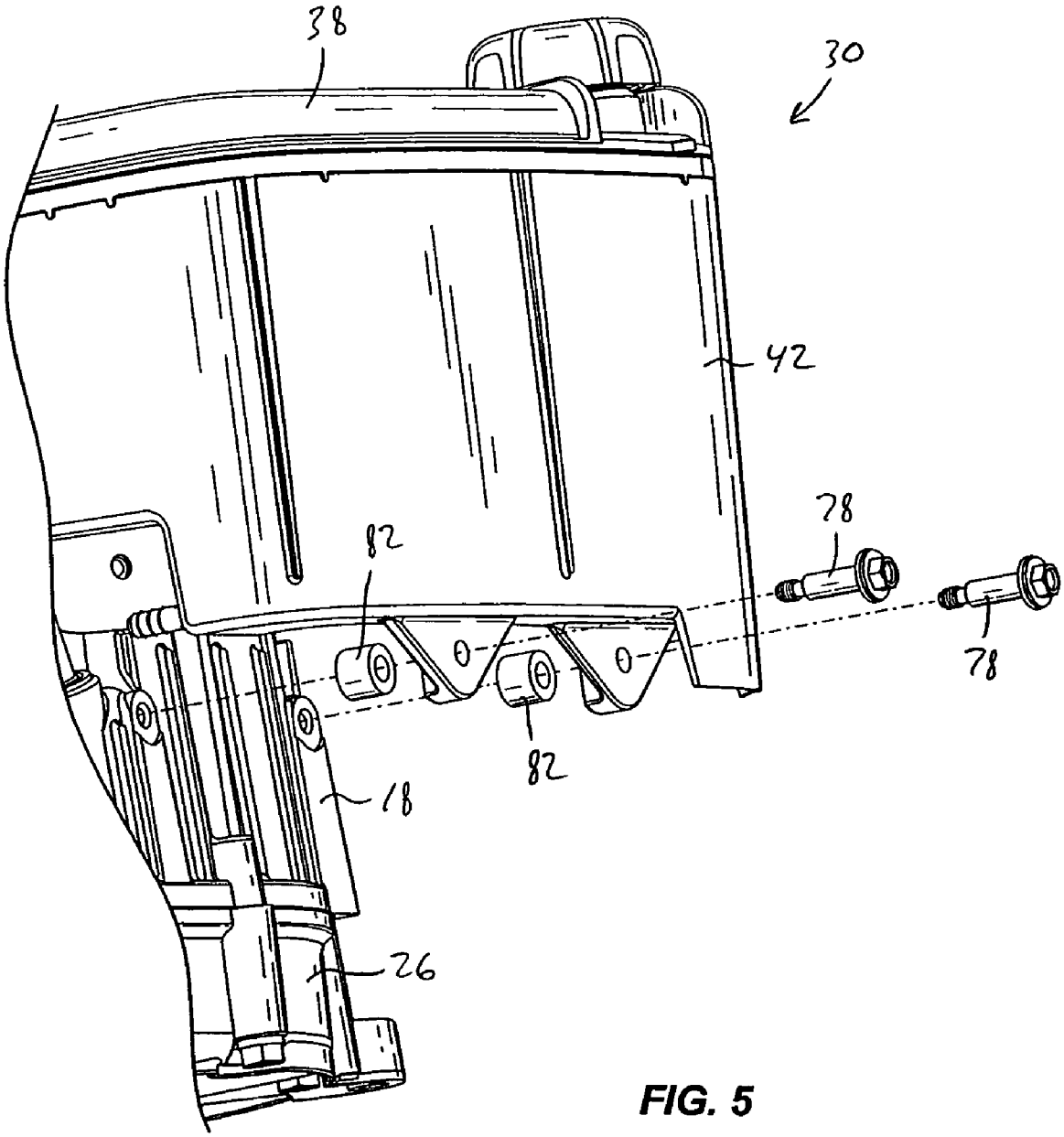
FIG. 5 is an enlarged, rear perspective view of the fuel tank exploded from the fan housing and an engine housing of the engine assembly of FIG. 1.

With reference to FIGS. 2 and 5, the engine 14 includes an engine housing 18 which may be formed as a single piece by any of a number of different processes (e.g., die casting, forging, etc.). The engine housing 18 generally includes a crankcase containing lubricant and a cylinder bore extending from the crankcase. The engine housing 18 also includes a flange at least partially surrounding the cylinder bore. The flange is a substantially flat surface to receive thereon a cylinder head 20 (see FIG. 2). The cylinder head 20 is fastened to the flange using a plurality of bolts around the outer periphery of the cylinder bore. The cylinder head 20 includes a combustion chamber which, in combination with the cylinder bore, is exposed to the combustion of an air/fuel mixture during operation of the engine 14.

Figure 7:
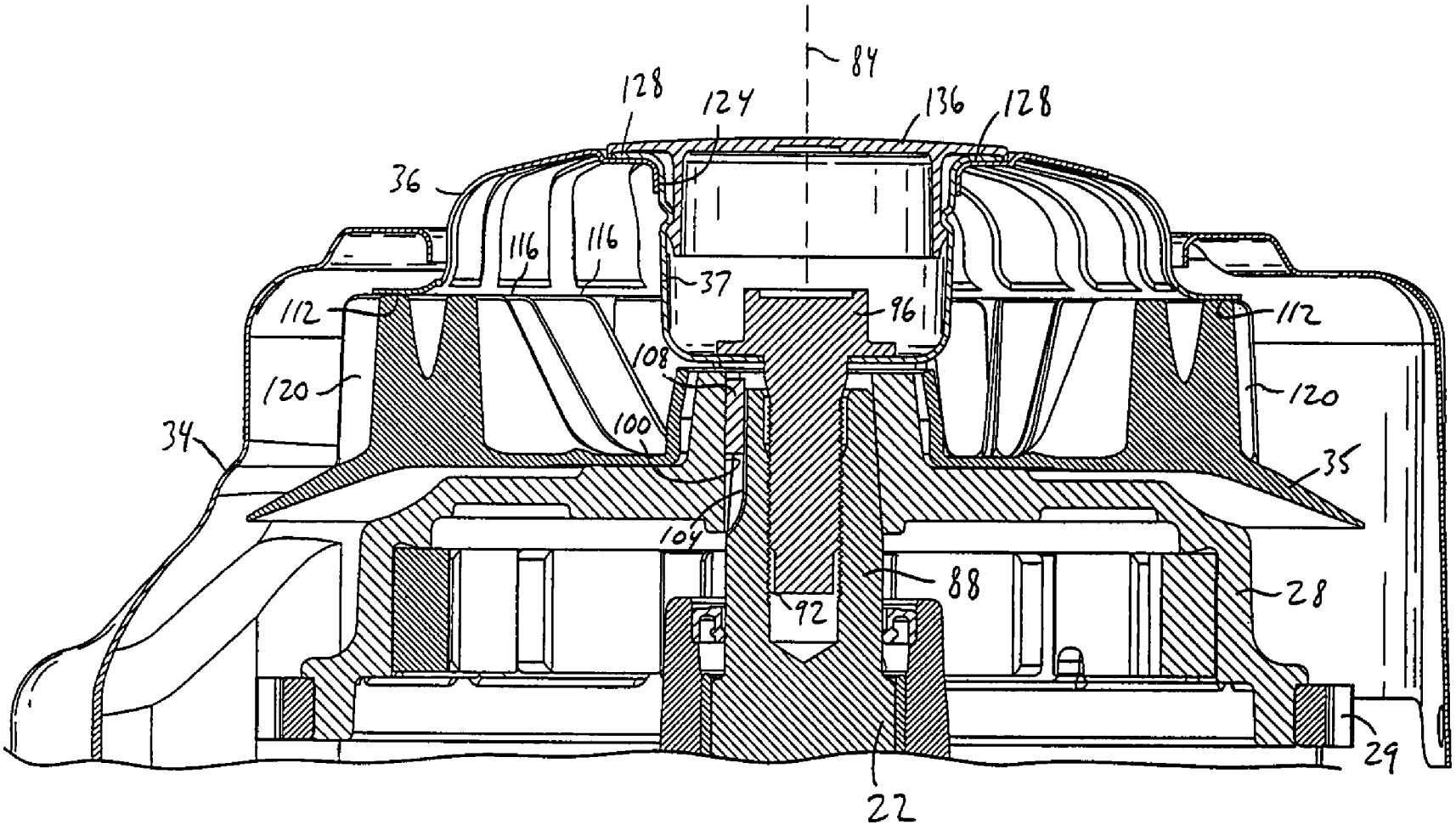
FIG. 7 is an enlarged, partial cross-sectional view through a portion of the engine assembly of FIG. 1 along line 7-7 in FIG. 1.

With reference to FIGS. 2 and 7, a crankshaft 22 is rotatably supported at one end by a journal formed on the crankcase, and at the other end by a similar journal formed on a crankcase cover 26 coupled to the crankcase. A piston is attached to the crankshaft 22 via a connecting rod for reciprocating movement in the cylinder bore as is understood in the art.

The illustrated engine 14 is also configured as an overhead valve engine 14 including a valve train incorporating a cam shaft gear driven by a crankshaft gear, and a cam shaft coupled to the cam shaft gear. The cam shaft includes intake and exhaust cam lobes thereon. Respective intake and exhaust tappets, supported in the engine housing 18 for reciprocating movement, engage the respective cam lobes on the cam shaft. The tappets engage respective intake and exhaust push rods, which, in turn, engage respective intake and exhaust rocker arms to translate the rotational movement of the cam shaft to vertical movement of intake and exhaust valves as is understood in the art. Alternatively, the engine may be configured as a side-valve or L-head engine.

The engine 14 may also include a lubrication system to provide lubricant to the working or moving components of the engine 14. As is understood in the art, the lubrication system may include a slinger that is drivably coupled to the cam gear or cam shaft, such that the slinger is intermittently submerged into the lubricant held in the crankcase, to circulate a lubricant throughout the crankcase to lubricate the working components or the moving components of the engine 14.

With reference to FIGS. 2 and 7, the engine 14 may also include an electric starter and a flywheel 28. When a user desires to start the engine 14 electrically, the user may depress a button or move a switch to activate the electric starter. Once activated, a starter gear extends toward the flywheel 28 and engages teeth 29 on the flywheel 28. The starter gear then rotates to impart a torque on the flywheel 28 to start the engine 14. Rather than using an electric starter, the engine 14 may utilize a manual starter.

With reference to FIGS. 1-4, the engine assembly 10 also includes a fuel tank 30 coupled to a blower or fan housing 34, which is positioned over the engine housing 18 and substantially encloses rotating components of the engine 14, including the flywheel 28, a fan 35, a rotating screen 36, and a retainer cup 38. As shown in FIG. 2, the fan 35 is a separate and distinct component from the flywheel 28. By providing the fan 35 and flywheel 28 as separate components, the flywheel 28 may be cast from a metallic material while the fan 35 may be formed from a less expensive plastic material. During operation of the engine 14, the fan 35 generates an airflow which is directed over the engine housing 18 and the cylinder head 20 by the fan housing 34 to air-cool the engine 14.

Figure 6:
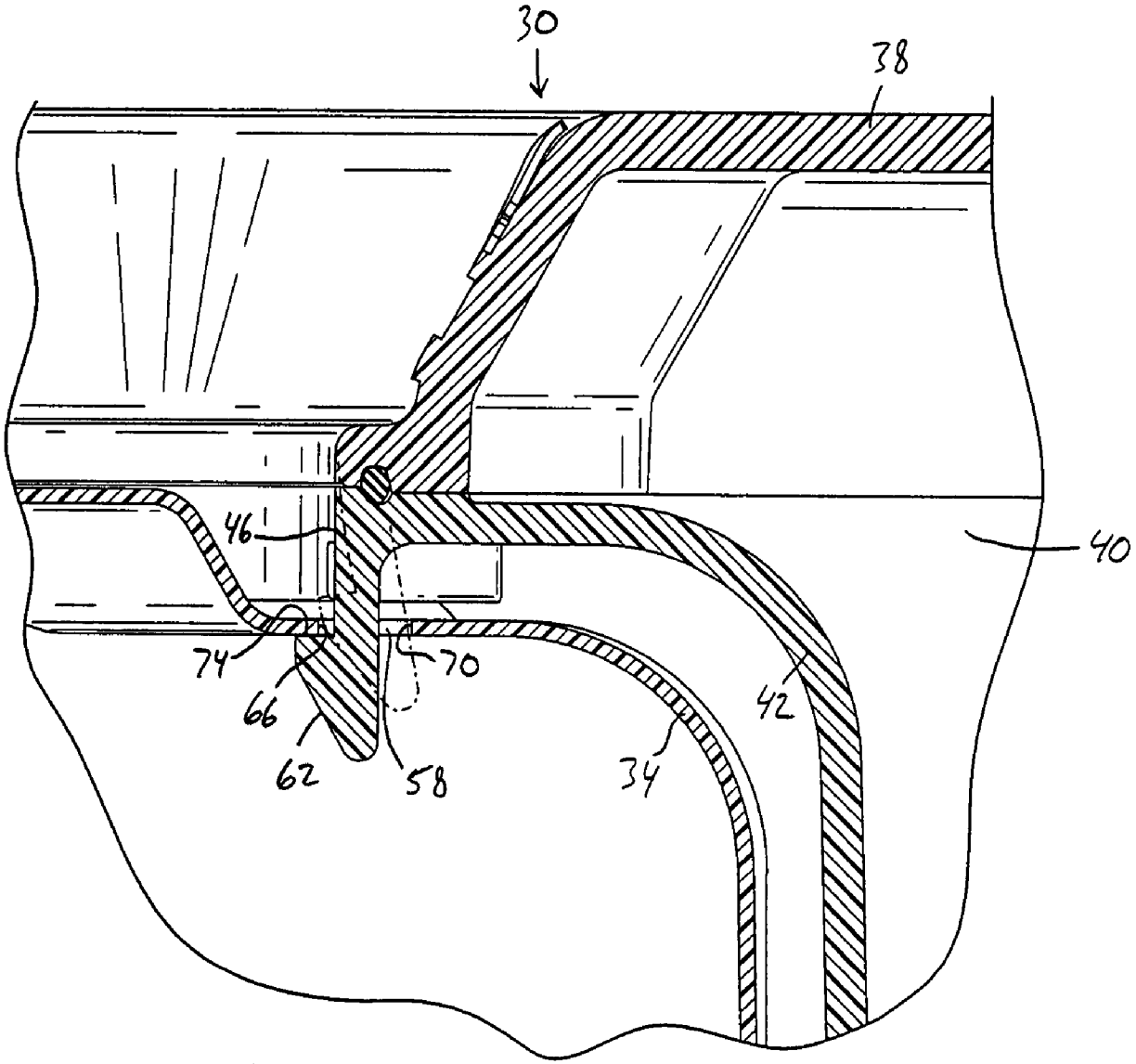
FIG. 6 is an enlarged, partial cross-sectional view through the fuel tank and fan housing of the engine assembly of FIG. 1 along line 6-6 in FIG. 1, illustrating a resilient locking member coupling the fuel tank to the fan housing.

The fuel tank 30 comprises a hollow body defining therein a fuel chamber 40 (see FIG. 6). In the illustrated construction of the engine assembly shown in FIGS. 1-7, the fuel tank 30 includes two separately-molded pieces, an upper piece 38 and a lower piece 42. The upper and lower pieces 38, 42 are hot-plate welded to form the fuel tank 30. However, in alternative constructions of the engine assembly, the fuel tank may be made as a single piece or a single body by using any of a number of different methods (e.g., by a blow-molding process).

Figure 3:
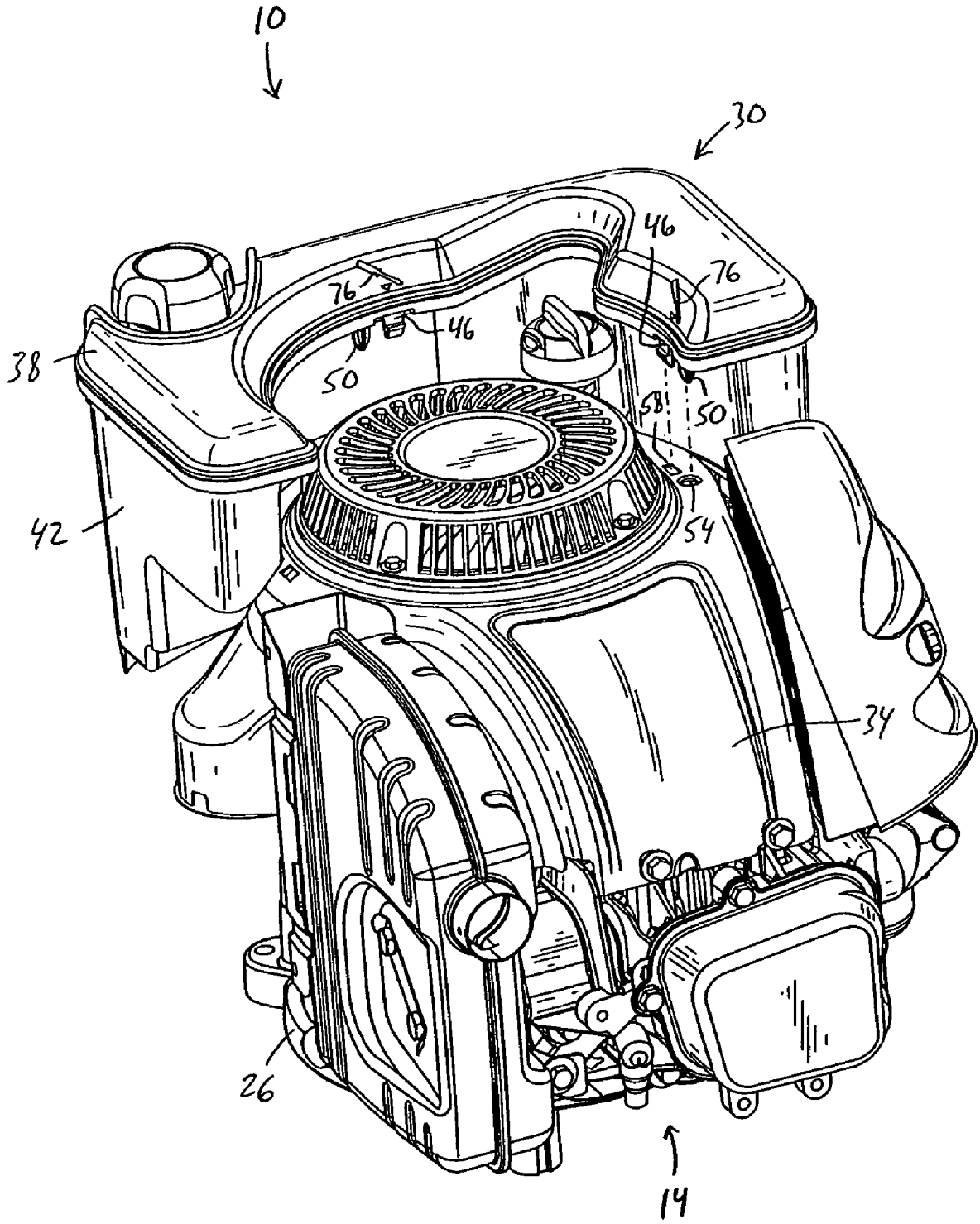
FIG. 3 is a partially-exploded, front perspective view of the engine assembly of FIG. 1, illustrating a fuel tank exploded from a fan housing of the engine assembly.
Figure 4:
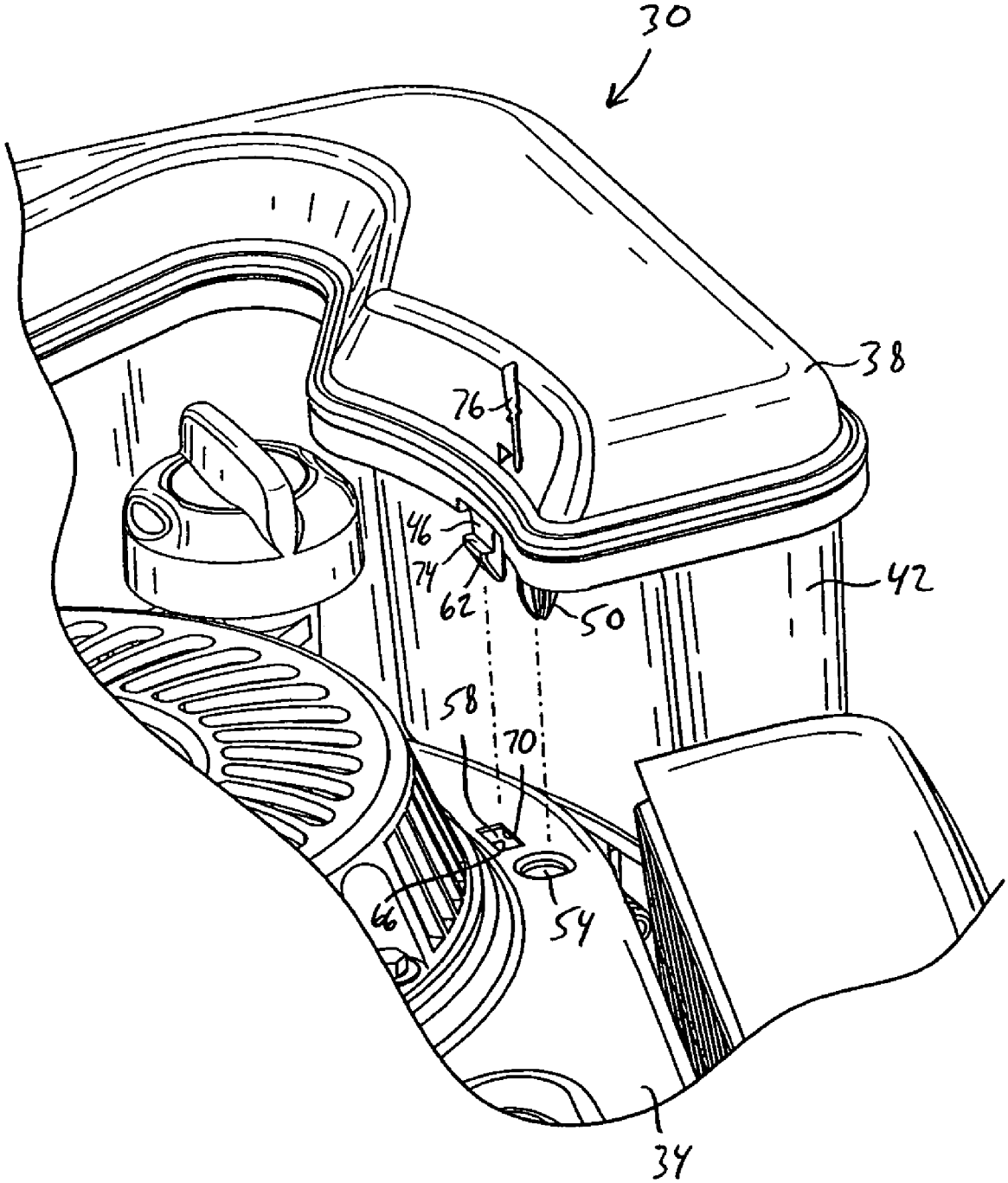
FIG. 4 is an enlarged view of the fuel tank and fan housing illustrated in FIG. 3.

With reference to FIGS. 2-4, multiple projections are integrally formed with the lower piece 42 to engage the fan housing 34 to couple the fuel tank 30 to the fan housing 34. Particularly, the projections are disposed in or engage respective apertures 54 or slots 58 in the fan housing 34. In the illustrated construction of the engine assembly 10, the projections are in the form of resilient locking members or snap tabs 46, and alignment members or posts 50. Alternative constructions of the fuel tank 30 may include projections only in the form of posts 50 that snugly engage the apertures 54 in the fan housing 34. Alternative constructions of the fuel tank 30 may also include projections only in the form of snap tabs 46 for engagement with the slots 58 to secure or lock the fuel tank 30 to the fan housing 34.

As shown in FIGS. 4 and 6, the snap tabs 46 include respective ramp portions 62 that engage side edges 66 of the respective slots 58 in the fan housing 34. Upon coupling the fuel tank 30 and the fan housing 34, the alignment posts 50 first engage the respective apertures or holes 54 in the fan housing 34 to align the fuel tank 30 with respect to the fan housing 34. After the fuel tank 30 and fan housing 34 are aligned, continued movement of the fuel tank 30 toward the fan housing 34 causes the ramp portions 62 of the snap tabs 46 to engage the side edges 66 of the respective slots 58 in the fan housing 34. As the ramp portions 62 engage the side edges 66 of the slots 58, the snap tabs 46 deflect toward side edges 70 of the slots 58 that are opposite the side edges 66 engaged by the ramp portions 62.

Upon continued movement of the fuel tank 30 toward the fan housing 34, the ramp portions 62 disengage the side edges 66 of the slots 58, allowing the snap tabs 46 to "snap back," or resume an undeflected state. Respective hook portions 74 of the snap tabs 46 abut a back surface of the fan housing 34 adjacent the side edges 66 to secure the fuel tank 30 to the fan housing 34 and substantially prevent the fuel tank 30 from being easily removed or easily separated from the fan housing 34.

With reference to FIG. 6, to remove the fuel tank 30 from the fan housing 34, the snap tabs 46 must first be deflected away from the side edges 66, toward the side edges 70. After the hook portions 74 of the snap tabs 46 are clear of the side edges 66, the fuel tank 30 may be removed from the fan housing 34. A preferred method of removing the fuel tank 30 from the fan housing 34 includes utilizing a hand tool, such as a screwdriver, to deflect the snap tabs 46 toward the side edges 70 of the fan housing 34. As shown in FIGS. 1-4, markings 76 on the fuel tank 30 may be used to indicate the locations of the snap tabs 46.

With reference to FIG. 5, the rear portion of the fuel tank 30 is fastened to the engine housing 18 to secure the rear portion of the fuel tank 30 to the engine housing 18. In the illustrated construction, bolts 78 are utilized to fasten the rear portion of the fuel tank 30 to the engine housing 18. Alternatively, other fasteners may be utilized to secure the rear portion of the fuel tank 30 to the engine housing 18. Further, additional snap tabs may be incorporated in the rear of the fuel tank 30 to engage corresponding slots or grooves formed in the engine housing 18 or other component of the engine 14.

Spacers 82 may also be positioned between the fuel tank 30 and the engine housing 18. The spacers 82 may be made from an elastomeric or vibration-damping material to reduce the amount of vibration transferred from the engine 14 to the fuel tank 30.

The fuel tank 30 illustrated in FIGS. 1-6 allows the same engine 14 to be used in applications requiring an attached fuel tank 30, such as a walk-behind lawnmower, and in applications requiring a remotely-positioned fuel tank, such as a riding lawnmower. The fuel tank 30 also reduces the number of fasteners required to attach the fuel tank 30 to the engine 14.

When the engine 14 is to be used with a walk-behind mower, the engine manufacturer may provide the engine assembly 10, including the fan housing 34 having the holes 54 and slots 58, to receive the alignment posts 50 and snap tabs 46 of the fuel tank 30, respectively. When the engine 14 is to be used with a riding mower, in which a remote fuel tank is often provided by the mower manufacturer, the engine manufacturer may interchange the fan housing 34 including the holes 54 and slots 58 to a fan housing without the holes and slots (not shown). Such interchangeability allows the engine manufacturer to use the same tooling to create both fan housings. Only an extra manufacturing step is required to create the holes 54 and slots 58, and a longer fuel line may be needed for the remote fuel tank. Alternately, the fan housing 34 having holes 54 and slots 58, may be used in both attached fuel tank and remote fuel tank applications.

With reference to FIG. 2, the flywheel 28, fan 35, rotating screen 36, and retainer cup 37 are rotatable about a central axis 84 defined by the crankshaft 22 (see also FIG. 7). The crankshaft 22 includes an end 88 having a threaded bore 92 which is coaxial with the central axis 84. A single fastener or bolt 96 is threaded into the threaded bore 92 in the end 88 of the crankshaft 22 to axially secure the flywheel 28, the fan 35, the screen 36, and the retainer cup 37. In the illustrated construction of the engine assembly 10, the flywheel 28 and the end 88 of the crankshaft 22 include respective keyways 100, 104 in which a key 108 is positioned to rotatably connect the crankshaft 22 and the flywheel 28. However, in alternative constructions of the engine assembly 10, any of a number of different methods may be used to rotatably connect the flywheel 28 and the crankshaft 22 (e.g., using splines).

With continued reference to FIG. 7, the screen 36 includes a bottom surface 112 that is engageable with the fan 35. Particularly, the bottom surface 112 of the screen 36 is engageable with respective side edges 116 of individual fan blades 120 on the fan 35 (see also FIG. 2). The screen 36 includes an aperture 124 coaxial with the central axis 84 through which the retainer cup 37 is received. The retainer cup 37 includes a flange 128 extending radially-outwardly from the central axis 84. The retainer cup 37 also includes a plurality of slots or notches 132 which may be engaged by respective dogs of a manual-start mechanism (e.g., a "pull starter"). As such, the same retainer cup 37 may be utilized in engine assemblies 10 including either an electric starter or a manual starter.

As shown in FIG. 7, the single fastener or bolt 96 axially secures the flywheel 28, the fan 35, the screen 36, and the retainer cup 37 to the end 88 of the crankshaft 22. A cap 136 (see also FIG. 2) may be coupled to the retainer cup 37 to cover the head of the bolt 96. Particularly, the screen 36 and the fan 35 are "sandwiched" between the flywheel 28 and the flange 128 of the retainer cup 37. In other words, the clamping force on the retainer cup 37, as applied by the single bolt 96, is transferred through the flange 128 on the retainer cup 37 to the screen 36, the fan 35, and the flywheel 28. As shown in FIG. 7, the fan 35 is axially restrained in a first direction along the central axis 84 by the flywheel 28 on a first side of the fan, and axially restrained in a second direction along the central axis 84 only by the screen 36 and the flange 128 of the retainer cup 37 on an opposite second side of the fan. The fan 35 does not include any structure to either rotationally secure the fan 35 to the flywheel 28 or axially secure the fan 35 to the flywheel 28. Such an arrangement utilizes a reduced number of fasteners compared to conventional engine assemblies, in which the rotating screens are often fastened directly to the flywheel.

Various features of the invention are set forth in the following claims.

What is claimed is:

1. An engine assembly comprising:

an engine housing;

a fan that generates an airflow;

a fan housing at least partially covering the engine housing and the fan to direct the airflow over the engine housing; and a fuel tank including a plurality of integrally-formed projections engaging the fan housing to couple the fuel tank to the fan housing.

2. The engine assembly of claim 1, wherein the projections include a plurality of resilient locking members, and wherein the fan housing includes a plurality of slots to receive the respective locking members.

3. The engine assembly of claim 2, wherein the slots in the fan housing each include a first side edge and a second side edge opposite the first side edge, and wherein the resilient locking members engage the first side edge and deflect toward the second side edge upon coupling the fuel tank to the fan housing.

4. The engine assembly of claim 3, wherein the resilient locking members each include a ramp portion and a hook portion, wherein the ramp portion engages the first side edge of the slot to deflect the locking member toward the second side edge, and wherein the hook portion engages an inner surface of the fan housing adjacent the first side edge when the ramp portion disengages the first side edge.

5. The engine assembly of claim 1, wherein the fan housing includes a plurality of apertures, and wherein the projections include a plurality of alignment members disposed in the apertures of the fan housing to orient the fuel tank with respect to the fan housing.

6. The engine assembly of claim 1, wherein the fuel tank includes a first portion and a second portion coupled to the first portion, and wherein a fuel chamber is defined between the first portion and the second portion.

7. The engine assembly of claim 6, wherein the projections are integrally formed with at least one of the first portion and the second portion of the fuel tank.

8. The engine assembly of claim 1, wherein the fuel tank is also fastened to the engine housing.

9. An engine assembly comprising:

an engine housing;

a crankshaft rotatably supported in the engine housing, one end of the crankshaft including a threaded bore defining a central axis;

a flywheel positioned adjacent the engine housing and coupled for rotation with the crankshaft about the central axis;

a fan separate from the flywheel and rotatable with the flywheel about the central axis;

a screen rotatable with the fan about the central axis;

a retainer cup rotatable with the screen about the central axis, the retainer cup including a flange extending radially outwardly from the central axis and engaging the screen;

a single fastener passing through the retainer cup, the screen, and the fan to threadably engage the threaded bore in the crankshaft and axially retain the flywheel, the fan, the screen, and the retainer cup to the crankshaft;

wherein the screen and the fan are sandwiched between the flywheel and the flange of the retainer cup; and wherein the fan is axially restrained in a first direction along the central axis by the flywheel, and a second direction along the central axis only by the screen and the flange of the retainer cup.

10. The engine assembly of claim 9, wherein the fastener exerts a clamping force on the retainer cup, and wherein the flange on the retainer cup exerts a clamping force on the screen and the fan.

* * * * *